United States Patent [19]

Hammarström

[11] 4,005,431

[45] Jan. 25, 1977

[54] SLOT ANTENNA WITH WAVEGUIDE COUPLING

[75] Inventor: Anders B. Hammarström, Lindome, Sweden

[73] Assignee: Telefonaktiebolaget L M Ericsson, Stockholm, Sweden

[22] Filed: May 30, 1975

[21] Appl. No.: 582,085

[30] Foreign Application Priority Data

June 26, 1974 Sweden ..... 7408385

[52] U.S. Cl. ..... 343/771; 343/770

[51] Int. Cl.[2] ..... H01Q 13/10

[58] Field of Search ..... 343/771, 767, 770

[56] References Cited

UNITED STATES PATENTS 3,363,253 1/1968 Ratkevich et al. ..... 343/771

*Primary Examiner*—Eugene La Roche

*Attorney, Agent, or Firm*—Hane, Sullivan & Spiecens

[57] ABSTRACT

An antenna for transmission of microwave energy, has a plate with openings for receiving energy from a feeding or input waveguide connected to an energy source and for feeding the received energy to a number of antenna or output waveguides provided with one or several openings through which energy from the feeding waveguide is to be emitted. The plate on the input side is provided with tracks in which a part of the feeding waveguide, which part together with the plate forms the feeding waveguide, is fixed, and the plate on the output side is provided with a number of tracks, in each of which a part of an antenna waveguide, which part together with the plate forms the antenna waveguide. In addition both the feeding waveguide part and each antenna waveguide part have the form of an open rectangular container, the edges of which together have the same form as the corresponding tracks of the plate, and the bottom of which is provided with one or several openings.

4 Claims, 6 Drawing Figures

SLOT ANTENNA WITH WAVEGUIDE COUPLING

The present invention refers to an antenna for transmission of electromagnetic energy, preferably within the microwave range. The antenna comprises a plate with openings for receiving energy from a feeding or input waveguide connected to, an energy source and feeding the received energy, to a number of antenna or output waveguides provided with one or several openings for emitting such received energy.

An object of the invention is to facilitate a considerable reduction of the manufacturing costs for antennas of the kind under consideration and to facilitate an increase of the possibilities of varying the capability of such antennas.

Antennas of the mentioned kind have previously been manufactured by salt bath soldering conventional waveguides with cut slots and open gables. Both dip soldering and the following surface conditioning have been difficult and time demanding working operations. The waveguide ends have been provided with gables which have been glued with electrically conducting glue. Thus, microwave leakage may then have arisen between different waveguides. Owing to the small dimensions of the waveguides (for example 19.05 mm × 9.525 mm) the punching of antenna slots is difficult to carry out. Such drawbacks are eliminated by the present invention.

The characteristics of the antenna designed according to the invention appear from the following claims.

The invention will be described more in detail in connection with the accompanying drawing where:

Figure 1:
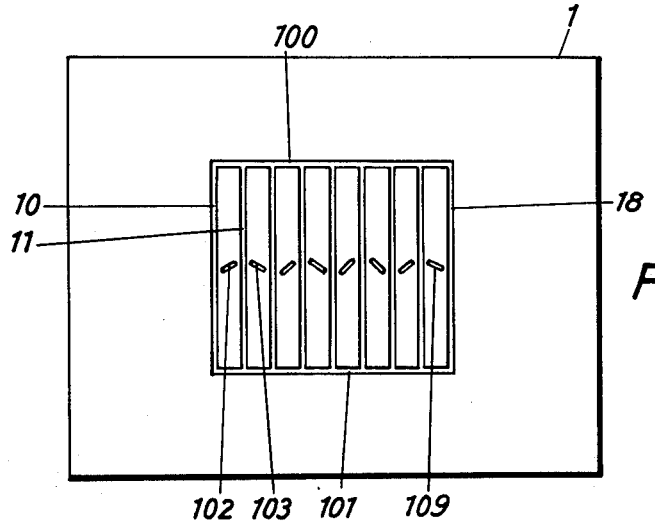
FIG. 1 shows from one side a plate included in an antenna according to the invention.

The plate 1 according to FIG. 1 is provided with a number of vertical tracks 10, 11 . . . 18 and two horizontal tracks 100 and 101. Several (4) of said tracks can be used so that they together form a continuous track, for example tracks 10, 100, 11 and 101, which tracks together form a rectangular track or waveguide wall-accepting means. The plate is further provided with a number of through openings 102, 103 . . . 109 intended for the feeding of energy from one side of the plate to its other side.

Figure 2:
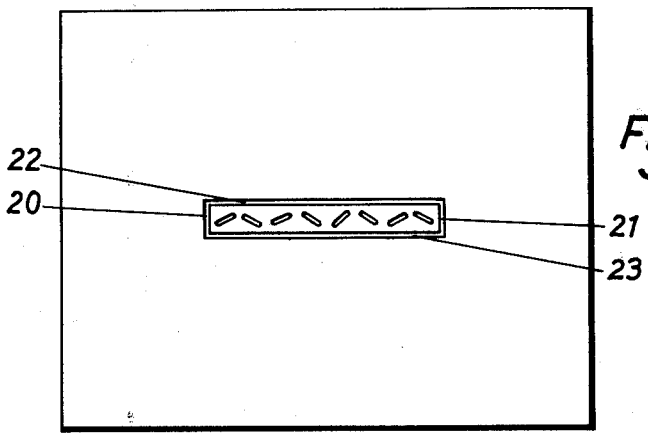
FIG. 2 shows the plate according to FIG. 1 from the other side.

In FIG. 2 is shown the opposite side of the plate 1. It is provided with two short vertical tracks 20, 21 and two long horizontal tracks 22, 23. These tracks form together a continuous rectangular track 20, 22, 21, 23 which is also a waveguide-wall-accepting means.

Figure 3:
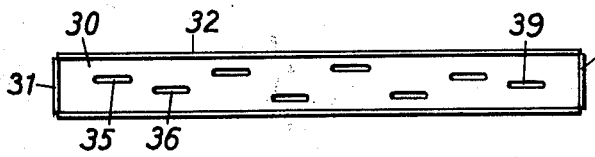
FIGS. 3 and 4 show a part of an antenna waveguide from below and from the side.
Figure 4:
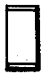

The part of an antenna waveguide shown in FIGS. 3–4 has the shape of an open rectangular container 30, the edges 31, 32, 33, 34 of which together have the same form as for example the continuous track 10, 100, 11, 101 in FIG. 1. The depth and width of this track are chosen so that the edges of the container 30 can fit in said continuous track. At the bottom of the antenna waveguide there are several openings 35, 36, – 39, which operate as output openings.

Figure 5:
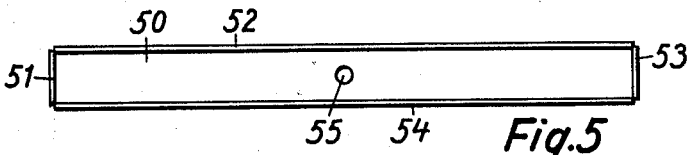
FIGS. 5 and 6 show a part of a feeding waveguide from below and from the side.
Figure 6:
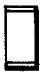

The part of a feeding waveguide shown in FIGS. 5–6 has the form of an open rectangular container 50, the edges 51, 52, 53, 54 of which together have the same form as the continuous track 20, 22, 21, 23. The depth and width of this track are chosen so that the edges of the container 50 can fit in said continuous track. At the bottom of the feeding waveguide there is an input opening 55.

The rectangular container 30 together with part of the plate 1 which part acts as a lid on the container, forms an antenna waveguide of which there are several on one side of the plate 1.

The rectangular container 50 together with part of the plate 1 which part acts as a lid on the container, forms an antenna waveguide on the other side of the plate 1.

The containers are pressed in the continuous track of the plate and glued. Other methods are also possible, for example bolting and soldering. It should be noted that the containers are properly oriented by virtue of the tracks in the plate.

To protect the antenna waveguide it is preferable to provide the antenna with an antenna cover which is glued both around the edges of the plate 1 and on the outer side of the bottom of the container 30. In this manner there is obtained a good contact. In addition the risk of buckling is eliminated.

We claim:

1. Antenna apparatus comprising: a plate having input and output sides; a plurality of first tracks cut into the output side of said plate, said first tracks being mutually parallel; a pair of second tracks cut into the output side of said plate, one of said second tracks being connected to first ends of each of said first tracks, and the other end of each of said second tracks being connected to second ends of each of said first tracks whereby a plurality of output-waveguide-wall-accepting means are formed, each having a major axis along a first direction; a pair of third tracks cut into the input side of said plate; a pair of fourth tracks cut into the input side of said plate, one of said fourth tracks being connected to first ends of said third tracks, and the other of said fourth tracks being connected to second ends of said third tracks whereby an input-waveguide-wall-accepting means is formed having a major axis which intersects the major axis of each of the formed output-waveguide-wall-accepting means; and said plate being provided with an opening in the region of each of the major axis intersections.

2. The antenna apparatus of claim 1 further comprising an input waveguide member fixed within the input waveguide-wall-accepting means, and a plurality of output waveguide members, each of said output waveguide members being fixed within a different one of the output waveguide-wall-accepting means.

3. The antenna of claim 1 wherein the major axis of the input waveguide-wall-accepting means is orthogonal to the major axis of the output waveguide-wall-accepting means.

4. The antenna of claim 1 wherein all of said first tracks have the same length and said second tracks are orthogonal to said first tracks.

* * * * *